United States Patent [19]

Clarke et al.

[11] 4,439,936

[45] Apr. 3, 1984

[54] SHOCK ATTENUATING OUTER SOLE

[75] Inventors: Thomas E. Clarke, Exeter; William R. Peterson, Portsmouth; Mark G. Parker, Exeter, all of N.H.

[73] Assignee: Nike, Inc., Beaverton, Oreg.

[21] Appl. No.: 384,545

[22] Filed: Jun. 3, 1982

[51] Int. Cl.[3] ..... A43B 5/00; A43B 1/10; A43B 13/18; A43B 13/04

[52] U.S. Cl. ..... 36/102; 36/129; 36/32 R; 36/25 R

[58] Field of Search ..... 36/102, 129, 32 R, 134, 36/67 A, 67 R, 127, 59 R, 59 C, 25 R; D2/274, 310, 320

[56] References Cited

U.S. PATENT DOCUMENTS

| | | | |
|---|---|---|---|
| D. 244,642 | 6/1977 | Famolare, Jr. | D2/320 |
| D. 245,734 | 9/1977 | Jacobs | D2/320 |
| D. 256,179 | 8/1980 | Famolare, Jr. | D2/320 |
| D. 257,799 | 1/1981 | Combaret | D2/320 |
| D. 258,775 | 4/1981 | Denu | D2/320 |
| 1,582,229 | 4/1926 | Smith . | |
| 2,814,133 | 11/1957 | Herbst | 36/71 |
| 3,100,354 | 8/1963 | Lombard et al. | 36/25 |
| 3,290,801 | 12/1966 | Bente . | |
| 3,507,059 | 5/1968 | Vietas . | |
| 4,043,058 | 8/1977 | Hollister et al. . | |
| 4,098,011 | 7/1978 | Bowerman et al. | 36/129 |
| 4,107,858 | 8/1978 | Bowerman et al. | 36/32 R |
| 4,130,947 | 12/1978 | Denu | 36/30 R |
| 4,180,923 | 1/1980 | Dassler | 36/32 R |
| 4,233,759 | 11/1980 | Bente et al. | 36/59 R |
| 4,259,792 | 4/1981 | Halberstadt . | |
| 4,268,980 | 5/1981 | Gudas | 36/43 |
| 4,271,606 | 6/1981 | Rudy | 36/32 R |
| 4,283,865 | 8/1981 | Dassler | 36/32 R |
| 4,305,211 | 12/1981 | Soomer . | |
| 4,316,335 | 2/1982 | Giese et al. | 36/129 |
| 4,319,412 | 3/1982 | Muller et al. . | |
| 4,327,503 | 5/1982 | Johnson | D2/320 |
| 4,372,058 | 2/1983 | Stubblefield . | |
| 4,378,643 | 4/1983 | Johnson . | |

FOREIGN PATENT DOCUMENTS

| | | | |
|---|---|---|---|
| 358954 | 10/1980 | Austria . | |
| 2489106 | 3/1982 | France | 36/32 R |

OTHER PUBLICATIONS

Birkenstock Advertisement.
Photograph A–Osaga Shoe.
Photograph B–Adidas Shoe.
Columbia Shoe Advertisement.
Advertisement of Avia, Tigard, Ore Referee/Coaching Shoe for Court Sports.

*Primary Examiner*—Werner H. Schroeder
*Assistant Examiner*—Steven N. Meyers
*Attorney, Agent, or Firm*—Banner, Birch, McKie & Beckett

[57] ABSTRACT

An outer sole for an athletic shoe is disclosed. The outer sole includes a base formed of a relatively thin resilient material and having a heel section, an arch section, a forefoot section, a toe section, an upper major surface and a lower major surface. A plurality of discrete traction elements extend downward from the lower major surface of the base at spaced transverse and longitudinal locations, and include a plurality of discrete heel and arch traction elements located about longitudinally spaced locations in the perimeter of base in the heel and arch sections respectively. A rear shock attenuating area extends generally along the central longitudinal portion of the heel and arch sections. The rear shock attenuating area is substantially devoid of traction elements so that the relatively thin resilient material of the base in the rear shock attenuating area depresses downwardly during foot strike to attenuate the force of foot strike.

30 Claims, 27 Drawing Figures

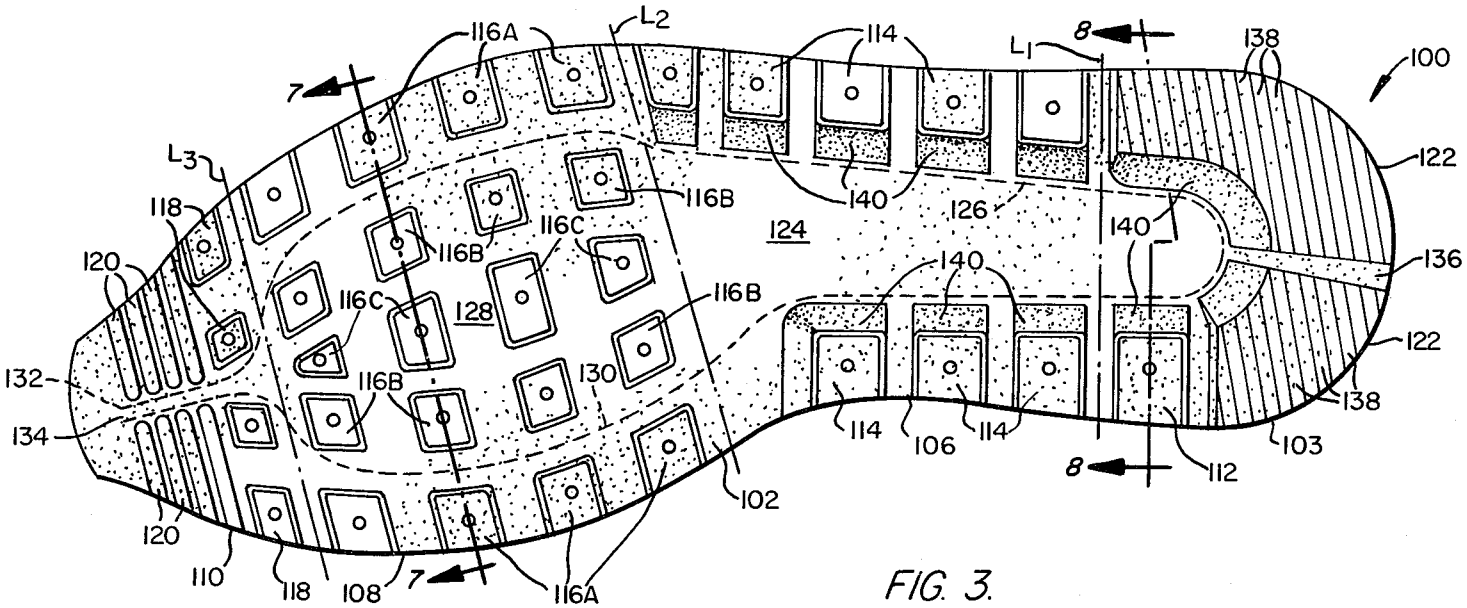
FIG. 3.
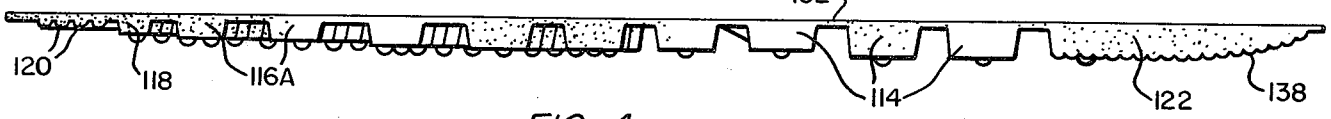
FIG. 4.
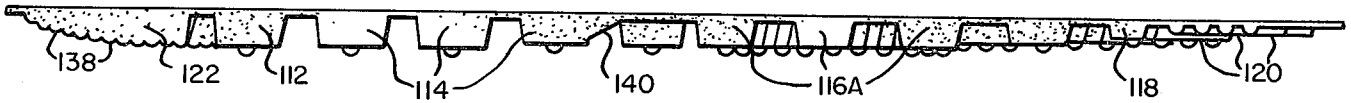
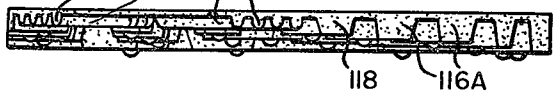
FIG. 5.
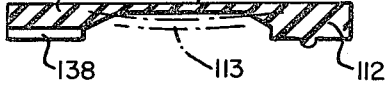
FIG. 8.
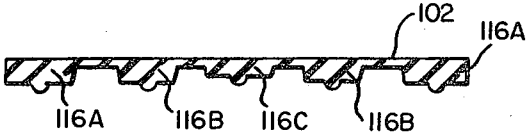
FIG. 7.
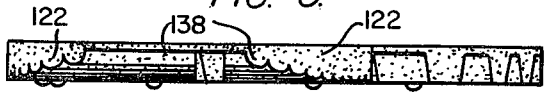
FIG. 6.

SHOCK ATTENUATING OUTER SOLE

TECHNICAL FIELD

The present invention relates to athletic shoes, and in particular, to an outer sole used with athletic shoes.

BACKGROUND OF THE INVENTION

The modern athletic shoe is a highly refined combination of many elements which have specific functions, all of which must work together for the support and protection of the foot during an athletic event. The shoe is divided into two general parts, an upper and a sole. The upper is designed to snuggly and comfortably enclose the foot. Typically, it will have several layers including a weather-and-wear resistant outer layer of leather or synthetic material such as nylon, and soft padded inner liner for foot comfort. Current uppers typically have an intermediate layer of a synthetic foam material. The three layers of the upper may be fastened together by stitching, gluing or a combination of these. In areas of maximum wear or stress, reinforcements of leather and/or plastic are attached to the upper.

The other major portion of the athletic shoe is the sole. Designed to withstand many miles of running, it must have an extremely durable bottom surface to contact the ground. However, since such contact may be made with considerable force, protection of the foot demands that the sole also perform a shock absorbing function. This shock absorbing function has been typically performed by a resilient, energy-absorbing material, which is located as a midsole between the durable lower surface material, i.e., the outer sole and the upper. This is particularly true for training or jogging shoes designed to be used over long distances and over a long period of time.

The outer sole has typically been designed to accomplish two functions, i.e., durability and traction. The capability of the outer sole as a contributing factor to shock absorbancy has generally been overlooked.

The outer sole design disclosed in U.S. Patent Application Ser. No. 178,088, filed on Aug. 14, 1980 and assigned to the assignee of the present application, took into consideration factors other than durability and traction. The structural design of the outer sole was related to a load analysis at the interface between the sole and the ground during running. The sole was then structured to minimize weight and maximize flexibility, while at the same time providing adequate durability, traction and stability. The design utilized transfer bars and ridges having varying widths and lengths. The ridges were located on the medial end lateral perimeter of the traction bars in the heel and forefoot section, and provided a slight cupping action.

A resilient shoe sole is disclosed in U.S. Pat. No. 3,100,354, issued on Aug. 13, 1963. The shoe sole in the '354 patent employs longitudinal rims along the lateral and medial sides of the sole interconnected by a thinner floor section. The lateral and medial rims are continuous and are not divided into traction elements and the outer sole appears to be connected directly to a shoe upper. The rims have an exemplary thickness of ¾" and the floor section has an exemplary thickness ¼". The '354 patent discloses that the thinner floor section cardles the foot so that the floor may largely conform to the foot structure.

SUMMARY OF THE INVENTION

The present is directed to an outer sole for an athletic shoe. The sole includes a base formed of a relatively thin resilient material. The base has a heel section, an arch section, a forefoot section, a toe section, an upper major surface and a lower major surface. A plurality of discrete traction elements extend downward from the base at spaced transverse and longitudinal locations. The traction elements include heel and arch traction elements located about longitudinally spaced locations in the perimeter of the base in the heel and arch sections respectively. A rear shock attenuating area extends generally along the central longitudinal portion of the heel and arch sections. The rear shock attenuating area is substantially devoid of traction elements so that the relatively thin resilient material of the base in the rear shock attenuating area presses downwardly during foot strike to attenuate the force of foot strike.

In a preferred embodiment, the traction elements include polygonal cleats in the heel, arch and forefoot sections, and wear plugs in the heel section. The wear plugs have a ground contact surface area substantially greater than the average ground contact surface area of the polygonal cleats.

In several embodiments of the outer sole, a front shock attenuating area is formed along the central longitudinal area of the forefoot section. The polygonal cleats in the front shock attenuation area are thinner than the polygonal cleats along the medial and lateral perimeter of the forefoot section. The relatively thin resilient base in the front shock attenuating area thus can also depress downwardly during foot strike to attenuate the force of foot strike. The shock attenuating areas reduce the shock or force of foot strike which is transmitted to the foot by an attenuation or time delay process rather than by an absorbancy process. Shock absorption is the typical manner in which a resilient midsole reduces the amount of shock or force of foot strike which is transmitted to the foot. The shock attenuating process of the outsole in accordance with the present invention increases the time over which the force of foot strike is transmitted by allowing the shock attenuating areas to depress or bend, rather than sharply or immediately transmitting the force. Additionally, the shock attenuation process occurs closer to the groundsole interface, than the shock absorbancy of a resilient midsole, which occurs closer to the foot of the runner. The amount which the foot depresses into the soft midsole is thus reduced which enhances foot stability.

Several embodiments of outer soles in accordance with the present invention are disclosed. Each embodiment has been designed to accommodate a particular type of runner. For example, one embodiment is designed for relatively lightweight, serious runners who do not have problems with pronation. Another embodiment is designed for lightweight serious runners who have a slight pronation problem. Another embodiment is designed for relatively heavy runners with no pronation problems, and a further embodiment is designed for either heavy runners with pronation problems or runners with serious pronation problems. Thus, the various embodiments accommodate the shock attenuating feature of the present invention to the weight and pronation tendencies of various types of runners.

A further feature of the present invention relates the design of the wear plugs. Wear plugs are traction elements located in the heel area of the outsole which have relatively large ground contact surface area and thickness to withstand the high wear which occurs in the heel area. Wear plugs are disclosed in U.S. Pat. No. 4,098,011. Traction ridges have been formed in prior art wear plugs. However, the traction ridges of the present invention are located in a manner to maximize the traction capability of the ridges during heel strike. Typically, runner's feet abduct (point their toes outward) from the direction of travel during running. At heel strike the angle of abduction is typically between 10 and 14 degrees from the straight forward direction. The traction ridges are placed substantially perpendicular to such a typical line of abduction to maximize traction at heel strike.

In several embodiments, the relatively thin base is thickened along the medial perimeter in the arch and heel sections. This provides a sturdier base for the cleats which extend from the thickened base portion and provides additional support on the medial side to inhibit pronation.

Various advantages and features of novelty which characterize the invention are pointed out with particularity in the claims annexed hereto and forming a part hereof. However, for a better understanding of the invention, its advantages and objects obtained by its use, reference should be had to the drawings which form a further part hereof and to the accompanying descriptive manner in which there is illustrated and described several embodiments of the invention.

BRIEF DESCRIPTION OF THE DRAWINGS

FIG. 2 is a bottom plan view of a first embodiment of the outer sole in accordance with the present invention, illustrating a left outer sole;

FIG. 3 is a side elevational view of the lateral side of the outer sole shown in FIG. 2;

FIG. 4 is a side elevational view of the medial side of the outer sole shown in FIG. 2;

FIG. 5 is a front elevational view of the outer sole in FIG. 2;

FIG. 6 is a rear elevational view of the outer sole shown in FIG. 2;

FIG. 7 is a sectional view taken generally along line 7—7 of FIG. 2;

FIG. 8 is a sectional view taken generally along line 8—8 of FIG. 2;

DETAILED DESCRIPTION OF THE INVENTION

Figure 1:
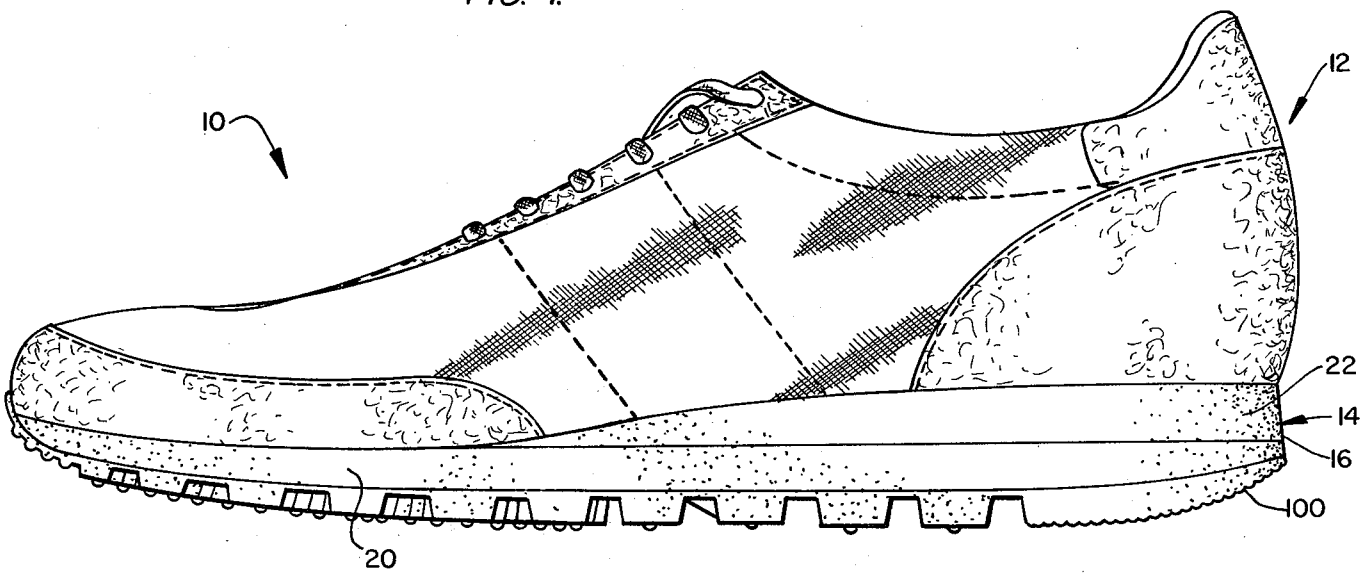
FIG. 1 is a side elevational view of an athletic shoe, including an outer sole, in accordance with the present invention.
Figure 9:
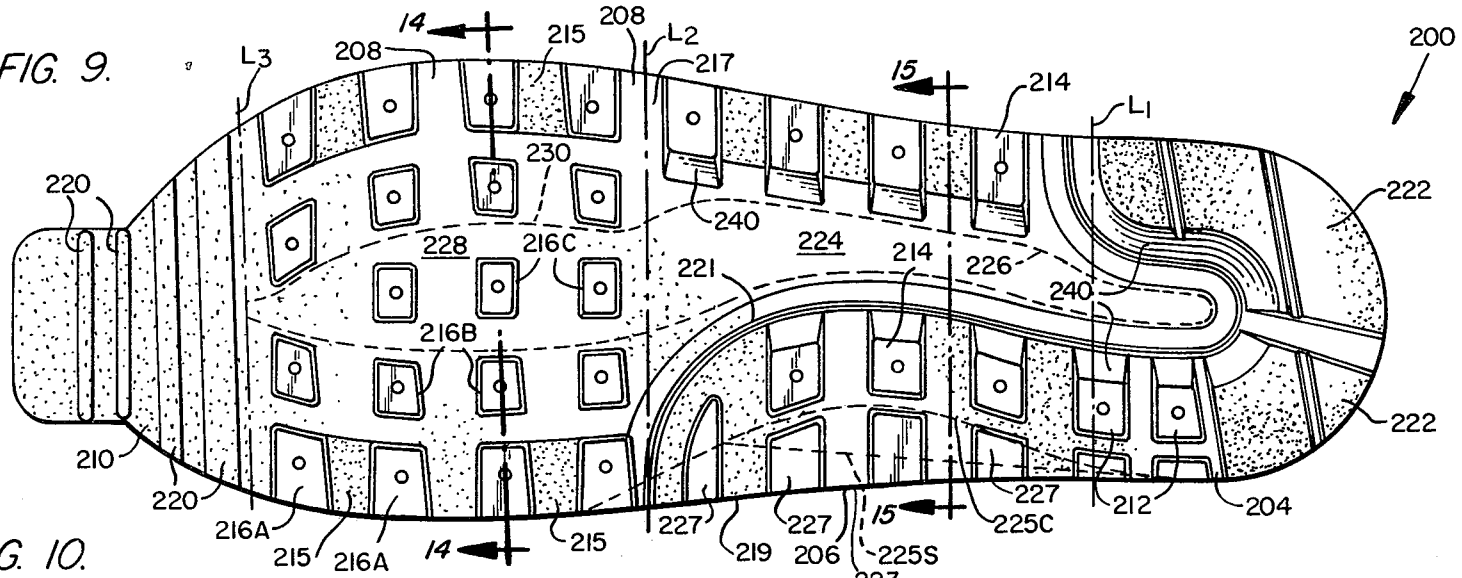
FIG. 9 is a bottom plan view of a second embodiment of outer sole in accordance with the present invention, illustrating a left outer sole.
Figure 10:
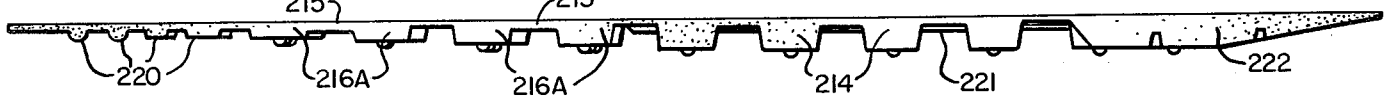
FIG. 10 is side elevational view of the lateral side of the outer sole shown in FIG. 9.
Figure 11:
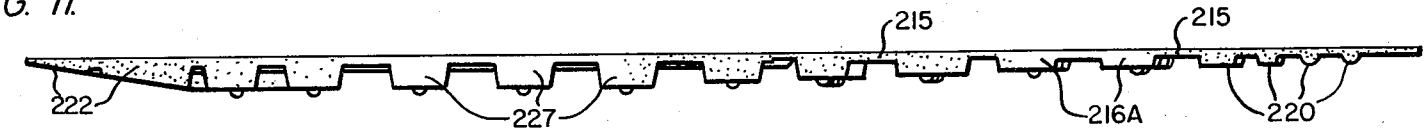
FIG. 11 is a side elevational view of the medial side of the outer sole shown in FIG. 9.
Figure 12:
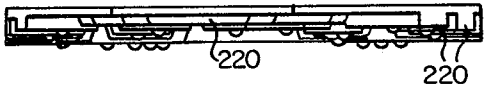
FIG. 12 is a front elevational view of the outer sole shown in FIG. 9.
Figure 13:
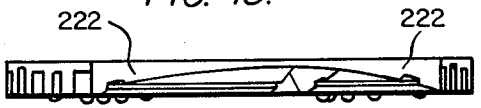
FIG. 13 is a rear elevational view of the outer sole shown in FIG. 9.
Figure 14:
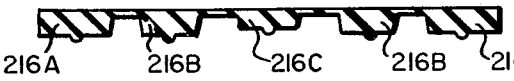
FIG. 14 is a sectional view taken generally along line 14—14 of FIG. 9.
Figure 15:
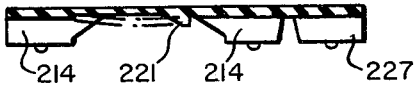
FIG. 15 is a sectional view taken generally along line 15—15 of FIG. 9.
Figure 16:
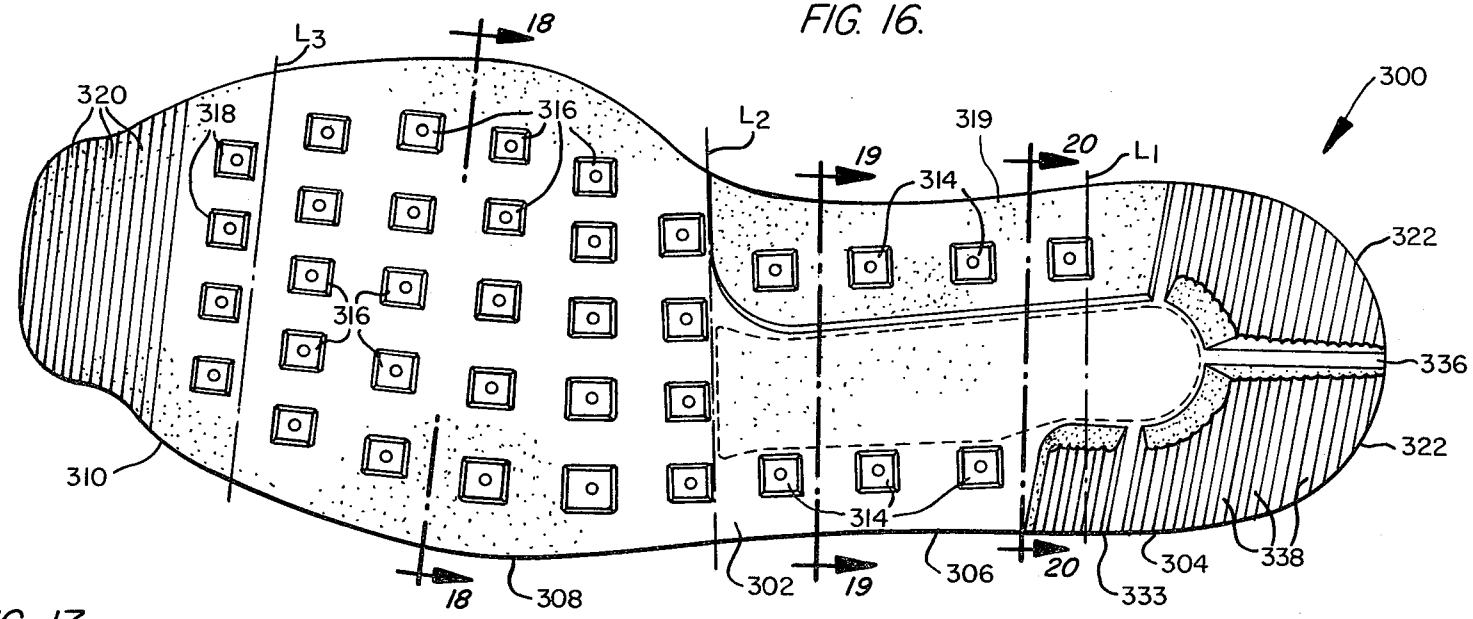
FIG. 16 is a bottom plan view of a third embodiment of outer sole in accordance with the present invention, illustrating a right outer sole.
Figure 17:
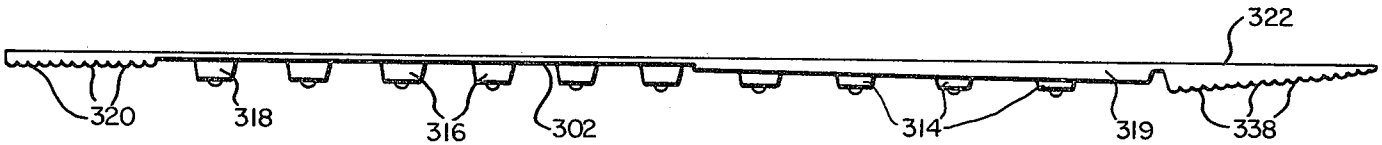
FIG. 17 is side elevational of the medial side of the outer sole shown in FIG. 16.
Figure 20:
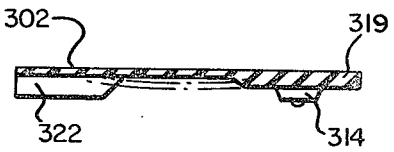
FIG. 20 is a sectional view taken generally along line 20—20 of FIG. 16.
Figure 19:
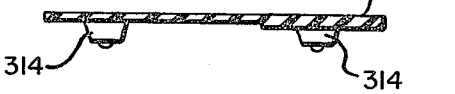
FIG. 19 is a sectional view taken generally along line 19—19 of FIG. 16.
Figure 18:
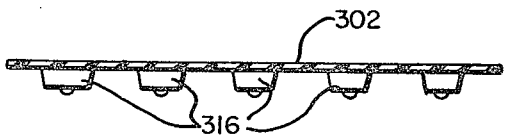
FIG. 18 is a sectional view taken generally along line 18—18 of FIG. 16.
Figure 21:
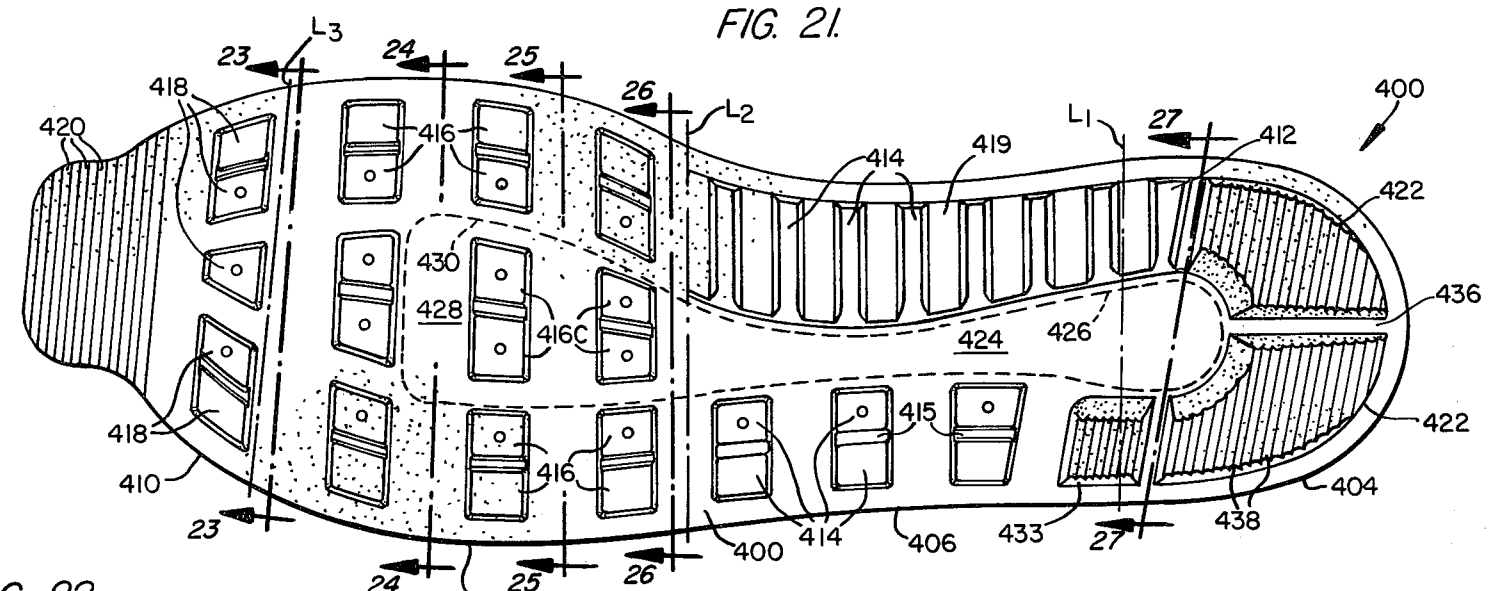
FIG. 21 is a bottom view of a fourth embodiment of outer sole in accordance with the present invention, illustrating a right outer sole.
Figure 22:
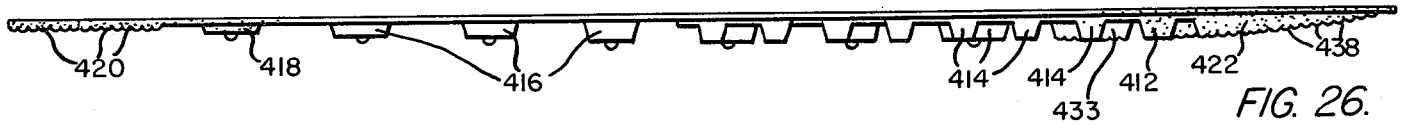
FIG. 22 is side elevational view of the medial side of the outer sole shown in FIG. 21.
Figure 26:
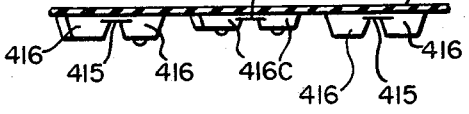
FIG. 26 is a sectional view taken generally along line 26—26 of FIG. 21.
Figure 27:
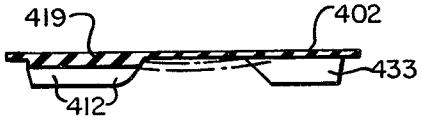
FIG. 27 is a sectional taken generally along line 27—27 of FIG. 21.
Figure 25:
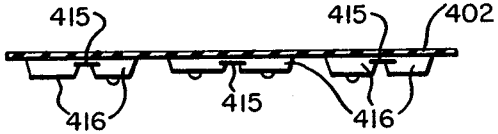
FIG. 25 is a sectional view taken generally along line 25—25 of FIG. 21.
Figure 23:
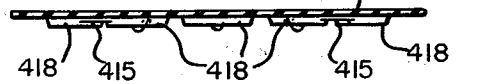
FIG. 23 is a sectional view taken generally along line 23—23 of FIG. 21.
Figure 24:
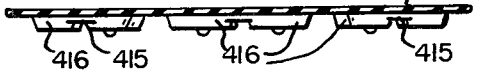
FIG. 24 is a sectional view taken generally along line 24—24 of FIG. 21.

Referring to the drawings in detail wherein like numerals indicate like elements, there is shown in FIG. 1 an athletic shoe in accordance with the present invention designated generally as 10. The shoe 10 includes a shoe upper 12 to which a multi-layered sole 14 is attached. Multi-layered sole 14 includes a midsole 16 and an outer sole 100. Outer sole 100, which will be described in greater detail hereinafter, is preferably made of a conventional hard resilient and flexible wear-resistant material such as rubber or a comparable synthetic material. Midsole 16 need not be as hard, but should be resilient and cushioning to absorb the shocks of running. Midsole 16 is preferably formed of a cushioning resilient material, such EVA, foamed polyurethane, or an encapsulated air cushion, such as shown in U.S. Pat. No. 4,271,606, issued on June 9, 1981. Midsole 16 is preferably formed of an intermediate layer 20 and a heel lift layer 22. Heel lift layer 22 is shown located above intermediate layer 20, however, these positions can be reversed, or layers 20, 22 can be formed integral.

Details of outer sole 100 will be described with reference to FIGS. 2–8. Outer sole 100 is made up of a relatively thin resilient base 102 from which a plurality of traction elements extend downwardly. The traction elements vary in shape and size, dependent upon their particular location along base 102 and the particular function they are to perform. Base 102 and outer sole 100 can be divided into four sections which relate roughly to four areas of the foot of a wearer. A heel section 104 is located generally rearward of line $L_1$; an arch section 106 is located generally between lines $L_1$ and $L_2$; a forefoot section 108 is located generally between lines $L_2$ and $L_3$; and a toe section 110 is located generally forward of line $L_3$.

The traction elements include polygonal shaped cleats 112, 114, 116 and 118. Cleat 112 is located in heel section 104, cleats 114 are located in arch section 106, cleats 116 area located in forefoot section 108 and cleats 118 are located in toe section 110. The traction elements additionally include transverse bars 120 in toe section 110, and wear plugs 122 in heel section 104. Each wear plug 122 has a ground contact surface area substantially greater than the average ground surface area of polygonal cleats 112–118. Both cleats 112–118 and wear plugs 122 have substantially greater thicknesses than base 102. Thus, wear plugs 122 serve to provide a large ground contact surface area at a point of high wear, i.e., at the heel.

A rear shock attenuating area 124 extends along the central longitudinal area of heel section 104 and arch section 106. The boundaries of rear shock attenuating area 124 area generally shown by dashed line 126. Rear shock attenuating area 124 occupies approximately the longitudinal center one-third of base 102 in the area through which it extends. The width of rear shock attenuating area 124 can vary from approximately one quarter of the width to a maximum of approximately one half the width. The width of the shock attenuating area should be such that sufficient traction and support by cleats 112, 114 remains for the particular type of runner for which the outsole is designed.

A front shock attenuating area 128 extends along the central longitudinal area of at least forefoot section 108. Central cleats **116*c* and intermediate cleats 116*b* are located in front shock attenuating area 128. Cleats 116*a* are located along the medial and lateral perimeter of forefoot section 108. Cleats 116*c* are centralmost and cleats 116*b* are located on either side of cleats 116*c* intermediate perimeter cleats 116*a*. At a given longitudinal location along outer sole 100, cleats 116*b* and 116*c* are thinner than cleats 116*a*. Similarly, centralmost cleat 116*c* at a given longitudinal location is thinner than intermediate cleats 116*b* on either side of it. As seen in FIGS. 3 and 4, the height of the cleats 116*a* decreases from the rear part of the forefoot section toward the front part of the forefoot section. This reduction in height lowers the weight of outsole 100**.

In sole 100, shock attenuating area 128 also extends forward through toe section 110, as illustrated by dashed line 132, by having a gap 134 extend through the central longitudinal area toe section 110 thereby dividing bars 120 into lateral and medial halves.

During foot strike, relatively thin resilient base 102 in the shock attenuating areas 124, 128 depresses slightly as shown in dot-dash line 113 in FIG. 8. This depressing motion spreads the force of impact which is transmitted to the foot over a slightly greater period of time, that is, instead of instantaneously stopping, as the perimeter cleats **114, 116*a***, the shock attenuating areas continue a downward motion. This delaying action attenuates, that is reduces the severity of the force of foot strike. As will be discussed with later embodiments, the location and size of the attenuating areas in addition to other features of the outsole can be adjusted to accommodate the outsole to a particular type of runner.

Wear plugs 122 are separated into medial and lateral wear plugs by a gap 136. Gap 136 extends downward to base 102. The splitting of rear wear plugs 122 into lateral and medial wear plugs has been done in prior art shoes. However, in the present invention, gap 136 is aligned with the line at which a typical runner abducts during heel strike, i.e., at an angle between 10 and 14 degrees from the central longitudinal axis of the heel and arch sections 104 and 106. Gap 136 minimizes the transmission of torque generated at initial heel strike from the lateral side to the medial side.

A plurality of ridges 138 form the ground contact surface of wear plugs 122. Ridges 138 are aligned substantially perpendicular to the line of abduction. Such alignment maximizes the traction of wear plugs 22 during heel strike.

Each cleat 112, 114 and wear plugs 122 have sidewalls 140 which extend from an inner edge of the contact surface of the cleats 112, 114 and wear plugs 122 inward toward the longitudinal center of the sole to meet with base 102. A wedge-shaped reinforcement is thus formed between the base 102 and the ground contact surfaces of the cleats and wear plugs. The reinforcement wedges are located along the inner side of cleats 112, 114 and wear plugs 122 and along the outer perimeter of the rear shock attenuating area 124. Cleats 112, 114 and wear plugs 122 are thus reinforced along the area of flexing between base 102 and cleats 112, 114 and wear plugs 122 and have connecting areas connected to base 102 larger than their respective ground contact areas.

In a preferred embodiment of outsole 100 the following dimensions have been found to be appropriate; a thickness of between 1/30,000 and 150,000 of an inch for base 102, a thickness of ¼ of an inch for cleats 112, 114, and varying the thickness of cleats **116*a*** from between approximately 3/16 of an inch to ⅛ of an inch.

Outsole 100 is particularly suitable for use by a heavy runner who does not have a pronation problem. To accommodate such a runner, relatively thick wear plugs 122 and cleats 112, 114 in the heel and arch area are used. Since the runner will be heavy, a relatively large degree of flexing will occur between the shock attenuating area and the cleats and wear plugs surrounding it. Thus, the reinforcing wedges defined by the sidewalls 140 are used to provide a more secure connection between the cleats and wear plugs and base 102, than would be provided by straight perpendicular walls. Also, since the runner is heavy, it is useful to extend the shock attenuating function into the forefoot section of the foot. Front shocks attenuating area extends over a relatively broad area therein, i.e., to the outermost cleats **116*a*** and over approximately one-half of the width of the forefoot section.

FIGS. 9 through 15 illustrate a second embodiment of outer sole 200. Elements of outer sole 200 which are similar to elements outer sole 100 will be indicated by like numbers in the 200 series.

Sole 200 is designed for use by a heavy runner with a pronation problem or by any runner with an extreme pronation problem. The design of outsole of 200 is accordingly modified to accommodate such runners. Features of sole 200 which are common to sole 100 will be described briefly, together with additional features of sole 200 which accommodate it for use by the type of runners described above.

A rear shock attenuating area 224 is shown roughly deliniated by dashed line 226. Rear shock attenuting area 224 is located along the central longitudinal area of heel section 204 and arch section 206 between cleats 212, 214 and wear plugs 222. Similarly, a front shock attenuating area 228 is shown between dashed lines 230. To accommodate sole 200 to a heavy runner with a pronation problem or to a runner with an extreme pronation problem, the width of shock attenuating areas 224, 228 is reduced and support along the lateral and medial sides is increased.

In forefoot section 208, additional support is provided on the lateral end of medial sides by making intermediate cleats **216*b* of the same thickness as the perimeter cleats 216*a*, and by locating thicker base portions 215** between adjacent longitudinal pairs of perimeter cleats 216*a*. Central cleats 216*c* in front shock attenuating area 228 are still thinner than perimeter cleats 216*a*. Central cleats 216*c* are also thinner than intermediate cleats 216*b*. The width of front shock attenuating area is thus reduced, while support on the lateral and medial sides of forefoot 208 is increased.

In the arch and heel sections 206, 204 additional support is provided for the pronator in several ways. First of all, base 202 is made in two portions, a thin portion 217, for example 1/30,000 of an inch to 1/50,000 of an inch, and a thick portion 219, for example 1/60,000 of an inch to 1/100,000 of an inch. Thin portion 217 extends substantially throughout toe portion 210, forefoot section 208, along rear shock attenuating area 224 in the arch and heel sections 206 and 204, and along the lateral side of the arch area 206. Thin portion 217 is thickened in small separate areas, such as portions 215 between perimeter cleats 216*a* and similarly between cleats 214 along the lateral side of the arch section.

Thick portion 219 is preferably made of a separate piece of material and extends along the medial side of arch section 206, the medial side of heel section 204, around the back of heel section 204 and into the lateral side of heel section 204. Thin portion 217 preferably has a thickened ridge 221 extending along the junction between thin and thick portions 217, 219. Portions 217, 219 are joined in a suitable manner, preferably by being directly molded to one another. Since thin portion 217 and thick portion 219 are preferably formed of two separate pieces of material, different types of material can be selected, so that thick portion 219 can be formed of a harder or stiffer material.

Additional support for the pronator is provided on the medial side by a medial extension 223 which extends base 202 transversely further out along arch section 206. In a normal curve last sole, sole 200 would be cut out approximately along the dot-dash line 225*c*. In a typical straight last, sole 200 would be cut out along dot-dash line 225S, so that the medial edge of the sole would extend inward from the broadest point of the forefoot section and, thereafter, extend substantially straight back to the heel. In contrast, extension 223 beings at the broadest point in forefoot section 208, approximately adjacent the ball of the foot, and extends substantially straight back from that point to the heel. Extension 223 thus provides substantial additional base area along the medial side of sole 200. Additional cleats 227 extend from extension 223 along its perimeter, so that cleats 212, 227 are arranged in transversely spaced pairs. Substantial medial support is provided by the thick portion 219 in extension 223 and the pairs of cleats 214, 227 and 212, 227.

In the illustrated embodiment of sole 200, ribs are not used on wear plugs 222, however, wear plugs 222 are divided by a split 236 extending along a generally longitudinal line aligned with the line at which a runner abducts. Similarly, transverse splits 235 are formed generally perpendicular to the line of abduction.

FIGS. 16–20 illustrate a third embodiment of outer sole 300. Elements of outer sole 300, which are similar to elements of outer soles 100 and 200, will be indicated by like numbers in the 300 series.

Sole 300 is designed to be used by a relatively lightweight and serious runner, without a pronation problem. The design of outsole 300 is accordingly modified to accommodate such runners. Features of sole 300 which are common to soles 100 and 200 will be described briefly, together with additional features of sole 300 which accommodate it for use by the type of runners described above.

A rear shock attenuating area 324 is formed along the central longitudinal area in the heel and arch sections 304, 306 and is approximately deliniated by dashed line 326. Wear plugs 322 are located about the rear of the heel section 304 and are divided into lateral and medial side wear plugs by a gap 336 which extends to base 302. Ridges 338 on wear plugs 322 are aligned substantially perpendicular to a line at a which a typical runner abducts. An additional wear plug 333 is located on the lateral side of sole 300 and extends in both the heel and arch sections 304, 306.

Base 302 includes a thick portion 319 along the medial side of arch section 304 and a forward portion of a heel section 304. However, since sole 300 is designed for use by a lightweight runner, portion 319 need not be as thick as portion 219. However, the thin portion of base 302 and thick portion 319 can also be approximately within the ranges specified for the thick and thin portions of base 202. Thick portion 319 provides a degree of anti-roll or antipronation stability and also provides a thicker base from which cleats 314 extend. Cleats 314 which extend from thick portion 319, thus do not depress into the cushioning midsole as readily as the cleats which extend from the thinner portion of base 302. This also enhances stability on the medial side. Cleats 314 are also made smaller than cleats 114 and 214.

A lightweight runner generally does not require the degree of shock absorbancy or shock attenuation as does a heavyweight runner, hence, a front shock attenuating area is not formed in outsole 300. Rather, since outsole 300 is designed for the serious runner, traction is given high priority in forefoot section 308. Therefore, cleats 316 are all formed of substantially uniform height and are skewed so that their gripping edges are generally in rows that are perpendicular to a line of abduction during the propulsion phase of running. Cleats 316 vary slightly in size from a maximum adjacent to the rear of forefoot section 308 to a minimum adjacent to the front of forefoot section 308. A number of cleats 318 are also located in toe section 310 as are a plurality of traversely extending ridges 320. Ridges 320 extend across the entire width of sole 300 without a split again for purposes of maximizing traction.

FIGS. 21 through 27 illustrate a fourth embodiment of outer sole 400. Elements of outer sole 400 which are similar to elements of the preceding embodiments of outer soles will be indicated by like numbers in the 400 series.

Sole 400 is designed for use by a lightweight, serious runner, with a slight pronation problem. The design of outsole 400 is accordingly modified to accommodate such runners. Features of sole 400 which are similar to features of the preceding embodiments of outer soles will be discussed, together with additional features of sole 400, which accommodate it for use by the type of runners described above.

A rear shock attenuating area 424 extends along the center longitudinal area of the heel and arch sections 404, 406, and is generally deliniated by dashed line 426. Similarly, a front shock attenuating area extends along a portion of the central area longitudinal area of forefoot section 408, and is generally delinated by dashed line 430. A thick portion 419 of base 402, similar to thick portion 319 is disposed along medial side of arch portion 406. Rear shock attenuating area 424 is not as wide as shock attenuating area 324 so as to accommodate more and larger cleats 414 along the medial side of arch area 406 and larger cleats 414 along the lateral side of arch area 406. In this manner, additional support is provided along the medial side to reduce the tendency of the runner to pronate. Thus, cleats 414, which extend along thick portion 419, extend across substantially the entire width of portion 419 and three pairs of transversely spaced cleats 414 are located along the lateral side of arch section 406. A small thickened portion 415 is located between adjacent pairs of cleats 414 on the lateral side. Wear plugs 422 and 433 are similr to wear plugs in outer sole 300. A pair of cleats 412 are located on the medial side of heel section 404.

Front shock attenuating area 428 extends only through a portion of forefoot section 408, and as with outer sole 300, a large number of cleats 416 are located in forefoot section 408 to maximize traction for the serious runner. Also, cleats 418 are located in toe section 410, as well as transverse ridges or bars 420. Most of the cleats 416, 418 are arranged in transversely spaced pairs with small thickened portions 415 of base 302 connecting the pairs. Sole 400 thus provides balanced shock attenuation, medial stability and traction for a lightweight runner with a slight pronation problem.

In summary, four embodiments of outsoles for use in athletic shoes are disclosed. Each outsole, to a lesser or greater degree, incorporates a shock attenuting area for the purpose of distributing or attenuating the force of foot strike and, thus, functioning in cooperation with the absorbancy of the cushioning midsole layer to protect the foot and leg from the force of foot strike. The shock attenuating area and cleats and wear plugs are shaped and arranged in various manners to accommodate various types of runner. While only four types of outsoles have been disclosed, the use of shock attenuating areas in combination with varying cleat arrangements and arrangements of thickened areas of a base of an outsole can be made in other combinations to accommodate various runners.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size and arrangement of parts, within the principle of the invention, to the full extent indicated by the broad general meaning of the terms in which the appended claims are expressed.

We claim:

1. An outer sole for an athletic shoe comprising:

a base formed of a relatively thin resilient material and having a heel section, an arch section, a forefoot section, a toe section, an upper major surface and a lower major surface;

a plurality of discrete traction elements extending downward from said lower major surface of said base at spaced transverse and longitudinal locations including a plurality of discrete heel and arch traction elements located about longitudinally spaced locations adjacent the perimeter of said base in said heel and arch sections respectively;

a rear shock attenuating area extending generally along the central longitudinal portion of said heel and arch sections, said rear shock attenuating area being substantially devoid of traction elements so that the relatively thin resilient material of said base in said rear shock attenuating area depresses downwardly during foot strike to attenuate the force of foot strike.

2. An outer sole in accordance with claim 1 wherein said plurality of traction elements includes forefoot traction elements in said forefoot section and toe traction elements in said toe section.

3. An outer sole in accordance with claim 2 wherein the traction elements in said forefoot section are in the form of cleats longitudinally and transversely spaced in said forefoot section.

4. An outer sole in accordance with claim 3 including a front shock attenuating area extending generally along the central longitudinal portion of said forefoot section wherein the cleats in the front shock attenuating area have a thickness less than the thickness of the cleats along the lateral and medial perimeter of said forefoot section whereby the thin base of said outer sole in said front shock attenuating area depresses during foot strike to attenuate the force of foot strike.

5. An outer sole in accordance with claim 4 wherein the thickness of the cleats in said forefoot section, at least along the medial and lateral perimeter thereof, decreases from a maximum at the rear part of said forefoot section to a minimum at the front part of said forefoot section.

6. An outer sole in accordance with claim 5 wherein the thickness of substantially all the cleats in said forefoot section decreases from a maximum at the rear part of said forefoot section to a minimum at the front part of said forefoot section.

7. An outer sole in accordance with claim 3 wherein the thickness of all cleats in said forefoot section is substantially uniform and the ground contact area of said cleats in said forefoot section gradually decreases from the rear part of said forefoot section to the front part of said forefoot section.

8. An outer sole in accordance with claim 2, 3 or 4 wherein the traction elements in the foreward portion of said toe section include transverse ribs.

9. An outer sole in accordance with claim 8 wherein the transverse ribs in the forward portion of said toe section are split along the center of the base to form a continuation of said front shock attenuating area.

10. An outer sole in accordance with claim 3 and 4 wherein said cleats have a generally polygonal shape in horizontal cross section.

11. An outer sole in accordance with claim 1 wherein at least some of the traction elements in the arch and heel section have side walls which extend from an inner ground engaging edge of the traction element toward a longitudinal center of the base to form a reinforcing wedge between the inner ground engaging edge of the traction element and the base.

12. An outer sole in accordance with claim 1 wherein the traction elements in the rearmost part of said heel section are in the form of wear plugs on the lateral and medial sides of the sole, each wear plug having a ground contact area substantially larger than the average ground contact area of the remainder of the traction elements.

13. An outer sole in accordance with claim 12 wherein said wear plugs have transverse ridges extending substantially perpendicular to the line at which a runner typically abducts.

14. An outer sole in accordance with claim 12 or 13 wherein a longitudinal split extends between a wear plug on the lateral side of the heel section and a wear plug on the medial side of the heel section, said longitudinal split extending substantially parallel to the line at which a runner abducts.

15. An outer sole in accordance with claim 1 wherein said base includes a thick portion thicker than the remaining thin portion of the base, said thick section extending at least along the medial side of the arch section.

16. An outer sole in accordance with claim 15 wherein several of said traction elements extend from said thick section of said base.

17. An outer sole in accordance with claim 15 wherein said thick section of said base further extends around the back of the heel section and a portion of the heel section on the lateral side of the sole.

18. An outer sole in accordance with claim 17 wherein said base is formed of two separate pieces of material, one piece forming the thin section of the base and the other piece of material forming the thick portion of the base, said two pieces of material being joined along a line wherein one of the pieces of material has a thickened flange thicker than the remainder of either piece of material.

19. An outer sole in accordance with claim 15, 16, 17 or 18 wherein said thin portion of the base has a thickness between approximately 30 and 50 thousandth of an inch and said thick portion of the base has a thickness between approximately 60 and 100 thousandth of an inch.

20. An outer sole in accordance with claim 1, 15, 16, 17 or 18 wherein the medial perimeter of said base extends substantially straight back from the outer most medial point of the base in the forefoot section to the heel to thereby provide additional medial support in the arch area of the foot.

21. An outer sole in accordance with claim 15, 16, 17 and 18 wherein the traction elements on the thick portion of said sole area arranged in transversely spaced pairs.

22. An outer sole in accordance with claim 15, 16, 17 and 18 wherein the traction elements on the thick portion of said sole area extend across substantially the entire width of said thick portion.

23. An outer sole in accordance with claim 1 wherein said rear shock attenuating area has an average width between approximately one-quarter and one-half of the average width of said base in said heel and arch sections.

24. An athletic shoe comprised of:

a shoe upper;

an outer sole attached to said upper, said outer sole including a base formed of relatively thin resilient material and having a heel section, an arch section, a forefoot section, a toe section, an upper major surface and a lower major surface;

a plurality of traction elements extending downward from said lower major surface of said base at transverse and longitudinally spaced locations substantially throughout said base;

a rear shock attenuating area extending along the central longitudinal portion of said heel and arch section, said rear shock attenuating area being substantially devoid of traction elements;

a front shock attenuating area extending generally along the central longitudinal portion of said forefoot section, traction elements along said front shock attenuating area being thinner than the traction elements along the medial and lateral perimeter area of said forefoot section so that the relatively thin resilient material of said base in said front and rear shock attenuating areas depresses downwardly during foot strike to attenuate the force of foot strike.

25. An athletic shoe comprised of:

a shoe upper;

an outer sole attached to said upper, said outer sole including a base formed of a relatively thin resilient material and having a heel section, an arch section, a forefoot section, a toe section, an upper major surface and a lower major surface;

a plurality of traction elements extending downward from said lower major surface of said base at transverse and longitudinally spaced locations in said heel, arch, and forefoot sections;

a rear shock attenuating area extending generally along the central longitudinal portion of said heel and arch sections, said rear shock attenuating area being substantially devoid of traction elements so that the relatively thin resilient material of said base in said rear shock attenuating area depresses downwardly during foot strike;

said base including a thick portion having a thickness greater than the remainder of said base, said thick portion extending along the medial perimeter of said base in said heel and arch sections and inward of the perimeter for approximately at least one quarter of the width of the base to provide additional medial support.

26. An athletic shoe comprising:

a shoe upper;

an outer sole attached to said upper, said outer sole including a base formed of a relatively thin resilient material and having a heel section, an arch section, a forefoot section, a toe section, an upper major surface and a lower major surface;

a plurality of traction elements extending downward from said lower major surface of said base at transversely and longitudinally spaced locations in said heel, arch and forefoot sections, said traction elements including wear plugs extending about substantially the entire rear portion of said heel section and forwardly along medial and lateral sides of said sole, the ground engaging surface of each of said wear plugs having an area substantially greater than the average ground engaging surface area of the remaining traction elements, said wear plugs including a plurality of ridges extending substantially perpendicular to a line at which a runner typically abducts;

a rear shock attenuating area extending generally along the central longitudinal portion of said heel and arch sections, said rear shock attenuating area being substantially devoid of traction elements so that the relatively thin resilient material of the base in the rear shock attenuating area depresses downwardly during foot strike.

27. An outer sole for an athletic shoe comprising:

a base formed of a relatively thin resilient material and having a heel section, an arch section, a forefoot section, a toe section, an upper major surface and a lower major surface;

a plurality of traction elements extending downwardly from said lower major surface of said base at transversely and longitudinally spaced locations within said heel, arch and forefoot sections, said traction elements including polygonal cleats in a portion of said heel section and in said arch and heel sections and wear plugs having ground engaging surface areas substantially greater than the average ground engaging surface area of the polygonal cleats, said wear plugs being located about the rear and lateral and medial sides of said heel section, said wear plugs having ridges extending substantially perpendicular to the line at which a runner typically abducts, said polygonal cleats in said heel and arch sections having a side wall along the inner side of the cleats extending from an inner ground engaging edge of the cleats toward a longitudinal center of said base to form a reinforcing wedge between the inner ground engaging edge of the cleats and said base;

a rear shock attenuating area extending generally along the central longitudinal portion of said heel and arch sections, said rear shock attenuating area being substantially devoid of traction elements;

a front shock attenuating area extending generally along the central longitudinal portion of said forefoot section, the polygonal cleats in said front shock attenuating area being thinner than the polygonal cleats along the medial and lateral perimeter of said forefoot section so that the relatively thin resilient material of the base in the front and rear shock attenuating areas depresses downwardly during foot strike to attenuate the force of foot strike.

28. An outer sole for an athletic shoe comprising:

a base formed of a relatively thin resilient material and having a heel section, an arch section, a forefoot section, a toe section, an upper major surface and a lower major surface, said base including a thick portion having a thickness greater than the remaining thin portion of said base, said thicker portion extending along the medial side of said arch and heel sections, about the rear of said heel section and about a portion of the lateral side of said heel section, the perimeter of said base along the medial side of said outer sole extending in a substantially straight line from the broadest point of said forefoot section to said heel;

a plurality of traction elements extending downwardly from said lower major surface of said base at longitudinally and transversely spaced locations in the heel, arch and forefoot sections, said traction elements including polygonal shaped cleats in said heel, arch and forefoot sections, and wear plugs in the heel section, said wear plugs having a ground contact surface area substantially greater than the average ground contact surface area of said polygonal cleats;

a rear shock attenuating area extending generally along the central longitudinal portion of said heel and arch sections, said rear shock attenuating area being substantially devoid of traction elements;

a front shock attenuating area extending generally along the central longitudinal portion of said forefoot section, the polygonal cleats in the front shock attenuating area being thinner than the polygonal cleats along the medial and lateral perimeter of said forefoot section so that the relatively thin resilient material of said base in said front and rear shock attenuating areas depresses downwardly during foot strike to attenuate the force of foot strike.

29. An outer sole for an athletic shoe comprising:

a base formed of a relatively thin resilient material and having a heel section, an arch section, a forefoot section, a toe section, an upper major surface, a lower major surface and a thick portion having a thickness greater than the remaining thin portion of the base, said thick portion extending along the medial perimeter in the arch and heel sections;

a plurality of traction elements extending downward from said lower major surface of said base at transverse and longitudinally spaced locations in the heel, arch and forefoot sections, said traction elements including generally polygonal shaped cleats in said heel, arch and forefoot section, and wear plugs having a substantially greater ground contact surface area than the average ground contact surface area of said polygonal cleats, said wear plugs extending about the rear of said heel section along the medial and lateral sides thereof;

a rear shock attenuating area extending generally along the central longitudinal portion of said heel and arch sections, said rear shock attenuating area being substantially devoid of traction elements;

a front shock attenuating area extending generally along the central longitudinal portion of said forefoot section, the polygonal cleats in said front shock attenuating area being thinner than the polygonal cleats along the lateral and medial perimeter of the forefoot section so that the relatively thin resilient material of the base in the front and rear shock attenuating areas depresses downwardly during foot strike to attenuate the force of foot strike.

30. An outer sole for an athletic shoe comprising:

a base formed of a relatively thin resilient material and having a heel section, an arch section, a forefoot section, a toe section, an upper major surface, a lower major surface and a thick portion having a thickness greater than the remaining thin portion of said base, said thick portion extending along the medial perimeter of said arch section;

a plurality of traction elements extending downward from said lower major surface of said base at longitudinally and transversely spaced locations in the heel, arch and forefoot sections said traction elements including polygonal cleats in said heel, arch and forefoot sections and wear plugs in said heel section, said wear plugs having a ground contact surface area substantially greater than the average ground contact surface area of said polygonal cleats, and ridges formed in said wear plugs extending generally perpendicular to the line at which a runner abducts;

a rear shock attenuating area extending generally along the central longitudinal portion of said heel and arch sections, said rear shock attenuating area being substantially devoid of traction elements so that the relatively thin resilient material of the base in the rear shock attenuating area depresses downwardly during foot strike to attenuate the force of foot strike.

* * * * *

UNITED STATES PATENT AND TRADEMARK OFFICE

CERTIFICATE OF CORRECTION

PATENT NO. : 4,439,936

DATED : April 3, 1984

INVENTOR(S) : Thomas E. Clarke, William R. Peterson and Mark G. Parker

It is certified that error appears in the above—identified patent and that said Letters Patent is hereby corrected as shown below:

Column 7, line 10, change "1/30,000" to —30/1000—;
line 10, change "1/50,000" to —50/1000—;
line 11, change "1/60,000" to —60/1000—; and
line 12, change "1/100,000" to —100/1000.

Signed and Sealed this

*Twenty-fifth* Day of *February 1986*

[SEAL]

*Attest:*

DONALD J. QUIGG

*Attesting Officer*

*Commissioner of Patents and Trademarks*